US008521055B2

(12) United States Patent
Ito

(10) Patent No.: US 8,521,055 B2
(45) Date of Patent: Aug. 27, 2013

(54) DEVELOPING DEVICE PROVIDED WITH THICKNESS-REGULATION MEMBER RESISTANT TO ABRASION

(75) Inventor: Yoshinori Ito, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 126 days.

(21) Appl. No.: 13/233,595

(22) Filed: Sep. 15, 2011

(65) Prior Publication Data

US 2012/0082477 A1 Apr. 5, 2012

(30) Foreign Application Priority Data

Sep. 30, 2010 (JP) ..... 2010-220567

(51) Int. Cl.
*G03G 15/08* (2006.01)

(52) U.S. Cl.
USPC ..... 399/103; 399/284; 399/286

(58) Field of Classification Search
USPC ..... 399/91, 98, 102, 103, 110, 111, 119, 399/252, 265, 279, 284–286
See application file for complete search history.

(56) References Cited

U.S. PATENT DOCUMENTS

| | | | | |
|---|---|---|---|---|
| 5,057,868 | A | 10/1991 | Sekino et al. | |
| 5,287,150 | A | 2/1994 | Kinoshita et al. | |
| 6,094,550 | A | 7/2000 | Kido et al. | |
| 6,980,752 | B2 * | 12/2005 | Kamimura | 399/103 |
| 7,336,913 | B2 * | 2/2008 | Sato et al. | 399/103 |
| 2005/0158070 | A1 | 7/2005 | Ishii | |
| 2012/0082476 | A1 | 4/2012 | Ito et al. | |

FOREIGN PATENT DOCUMENTS

| | | | |
|---|---|---|---|
| JP | H02-210475 | A | 8/1990 |
| JP | H05-307326 | A | 11/1993 |
| JP | H06-011958 | A | 1/1994 |
| JP | H09-022185 | A | 1/1997 |
| JP | H11-073017 | A | 3/1999 |
| JP | 2001-154480 | A | 6/2001 |
| JP | 2001-356593 | A | 12/2001 |
| JP | 2005-189346 | A | 7/2005 |

* cited by examiner

*Primary Examiner* — Hoan Tran
(74) *Attorney, Agent, or Firm* — Baker Botts L.L.P.

(57) ABSTRACT

A developing device includes a casing having an opening extending in a first direction, a developing roller, a thickness-regulation portion, a sealing member and a contact portion. The thickness-regulation portion includes a thin-plate member and a regulating portion. The thin-plate member has a base end portion fixed to the casing and a free end portion to which the regulating portion is fixed. The thin-plate member has a lateral end extending in a second direction. The regulating portion has an end face extending in a direction. The sealing member is disposed on the thin-plate member and in intimate contact with the end face of the regulating portion. The contact portion is fixed on the thin-plate member at a position closer to the lateral end than the sealing member to the lateral end and made of a material whose hardness is higher than that of the sealing member.

7 Claims, 7 Drawing Sheets

DEVELOPING DEVICE PROVIDED WITH THICKNESS-REGULATION MEMBER RESISTANT TO ABRASION

CROSS REFERENCE TO RELATED APPLICATION

This application claims priority from Japanese Patent Application No. 2010-220567 filed Sep. 30, 2010. The entire content of the priority application is incorporated herein by reference.

TECHNICAL FIELD

The present invention relates to an image forming device, and also to a developing device and a process unit mountable on the image forming device.

BACKGROUND

In a conventional electrophotographic image forming device, an electrostatic latent image is formed on a photosensitive drum. Toner accommodated within a developing cartridge is supplied to the electrostatic latent image, thereby forming a toner image on the photosensitive drum. The toner image is then transferred onto a sheet to form an image on the sheet.

One of such conventional developing cartridges includes a casing, a toner accommodation chamber for storing toner therein, a developing roller rotatably supported to the casing, a leaf spring whose one end is supported to the casing, a thickness regulation member disposed in opposition to the developing roller, and sealing members disposed on both widthwise ends of the developing roller. The thickness regulation member includes a thickness regulating section formed of an insulative silicon rubber and attached to another end of the leaf spring. The sealing member is in contact with an outer circumferential surface of the developing roller and is attached to the leaf spring for sealing a gap between the developing roller and the thickness regulating section to prevent toner from leaking outside from the casing.

SUMMARY

In the above-described configuration of the developing cartridge, the thickness regulating section has a length shorter than that of the outer circumferential surface of the developing roller in an axial direction of the developing roller. That is, in the axial direction of the developing roller, the thickness regulating section is end up with a central portion that is in contact with the developing roller with a surface, and both widthwise end portions each in contact with the developing roller with a point. As a result, the widthwise end portions of the thickness regulating section is applied with a pressure higher than that applied to the central portion of the thickness regulating section.

Further, in the above-described configuration of the developing cartridge, the sealing members are disposed outward of the widthwise end portions of the thickness regulating section in the axial direction of the developing roller. Since the sealing member is formed of a material softer than that of the thickness regulating section, the sealing member and the thickness regulating section are in contact with the developing roller with contact pressures different from each other. In other words, the contact pressure with which the sealing member is in contact with the developing roller is smaller than the contact pressure with which the widthwise end portions of the thickness regulating section are in contact with the developing roller.

Therefore, when the above developing cartridge is continued to be used for a long period of time in a state where the thickness regulating section and the sealing members are respectively in contact with the developing roller, the widthwise end portions of the thickness regulating section positioned adjacent to the sealing members tend to be worn out faster (more easily) than the central portion of the thickness regulating section due to the contact pressure largest in the axial direction of the developing roller.

If the widthwise end portions of the developing roller are worn out, the thickness regulating section cannot fully scrape off toner from the developing roller. As a result, toner could be adhered to other member that is in contact with the developing roller, leading to a possible leakage of toner from the casing of the developing cartridge.

In view of the foregoing, it is an object of the invention to provide a developing device capable of suppressing attrition of widthwise end portions of a thickness regulation member, and also to provide a process unit and an image forming apparatus incorporating the developing device.

In order to attain the above and other objects, there is provided a developing device including a casing, a developing roller, a thickness-regulation portion, a sealing member and a contact portion. The casing has an opening extending in a first direction. The developing roller is positioned adjacent to the opening and is configured to rotate about an axis extending in the first direction. The developing roller has an outer circumferential surface on which developer is carried. The thickness-regulation portion includes a thin-plate member and a regulating portion. The thin-plate member extends in the first direction along the opening and has a base end portion fixed to the casing and extending in the first direction and a free end portion, the thin-plate member having a lateral end extending in a second direction crossing the first direction. The regulating portion extends in the first direction and is fixed to the free end portion of the thin-plate member, the regulating portion being in contact with the outer circumferential surface of the developing roller via the developer for regulating thickness of the developer on the outer circumferential surface, the regulating portion having an end face extending in a direction crossing the first direction. The sealing member is disposed on the thin-plate member and in intimate contact with the end face of the regulating portion for suppressing leakage of the developer from the casing. The contact portion is fixed on the thin-plate member at a position closer to the lateral end than the sealing member to the lateral end, the contact portion being in contact with the outer circumferential surface of the developing roller and made of a material having a hardness higher than that of the sealing member.

According to another aspect of the present invention, there is provided a process unit including a photosensitive member and a developing device. The photosensitive member has a circumferential surface on which an electrostatic latent image is formed. The developing device includes a casing, a developing roller, a thickness-regulation portion, a sealing member and a contact portion. The casing has an opening extending in a first direction. The developing roller is positioned adjacent to the opening and is configured to rotate about an axis extending in the first direction. The developing roller has an outer circumferential surface on which developer is carried. The thickness-regulation portion includes a thin-plate member and a regulating portion. The thin-plate member extends in the first direction along the opening and has a base end portion fixed to the casing and extending in the first direction and a free end portion, the thin-plate member having a lateral end extending in a second direction crossing the first direction. The regulating portion extends in the first direction and is fixed to the free end portion of the thin-plate member, the regulating portion being in contact with the outer circumferential surface of the developing roller via the developer for regulating thickness of the developer on the outer circumferential surface, the regulating portion having an end face extending in a direction crossing the first direction. The sealing member is disposed on the thin-plate member and in intimate contact with the end face of the regulating portion for suppressing leakage of the developer from the casing. The contact portion is fixed on the thin-plate member at a position closer to the lateral end than the sealing member to the lateral end, the contact portion being in contact with the outer circumferential surface of the developing roller and made of a material having a hardness higher than that of the sealing member.

According to still another aspect of the present invention, there is provided an image forming device including a process unit, an exposure unit, a transfer unit and a fixing unit. The process unit includes a photosensitive member and a developing device. The exposure unit exposes a scanned light to the photosensitive member. The transfer unit transfers a developer image formed in the process unit to a sheet. The fixing unit fixes the developer image to the sheet. In the process unit, the photosensitive member has a circumferential surface on which an electrostatic latent image is formed. The developing device includes a casing, a developing roller, a thickness-regulation portion, a sealing member and a contact portion. The casing has an opening extending in a first direction. The developing roller is positioned adjacent to the opening and is configured to rotate about an axis extending in the first direction. The developing roller has an outer circumferential surface on which developer is carried. The thickness-regulation portion includes a thin-plate member and a regulating portion. The thin-plate member extends in the first direction along the opening and has a base end portion fixed to the casing and extending in the first direction and a free end portion, the thin-plate member having a lateral end extending in a second direction crossing the first direction. The regulating portion extends in the first direction and is fixed to the free end portion of the thin-plate member, the regulating portion being in contact with the outer circumferential surface of the developing roller via the developer for regulating thickness of the developer on the outer circumferential surface, the regulating portion having an end face extending in a direction crossing the first direction. The sealing member is disposed on the thin-plate member and in intimate contact with the end face of the regulating portion for suppressing leakage of the developer from the casing. The contact portion is fixed on the thin-plate member at a position closer to the lateral end than the sealing member to the lateral end, the contact portion being in contact with the outer circumferential surface of the developing roller and made of a material having a hardness higher than that of the sealing member.

DETAILED DESCRIPTION

First, a general configuration of a color laser printer 1 according to an embodiment of the present invention will be described with reference to FIG. 1.

Throughout the specification, the terms "above", "below", "right", "left", "front", "rear" and the like will be used assuming that the color laser printer 1 is disposed in an orientation in which it is intended to be used. More specifically, in FIG. 1, a right side, a left side, a near side and a far side will be referred to as a front side, a rear side, a left side and a right side, respectively.

Figure 1:
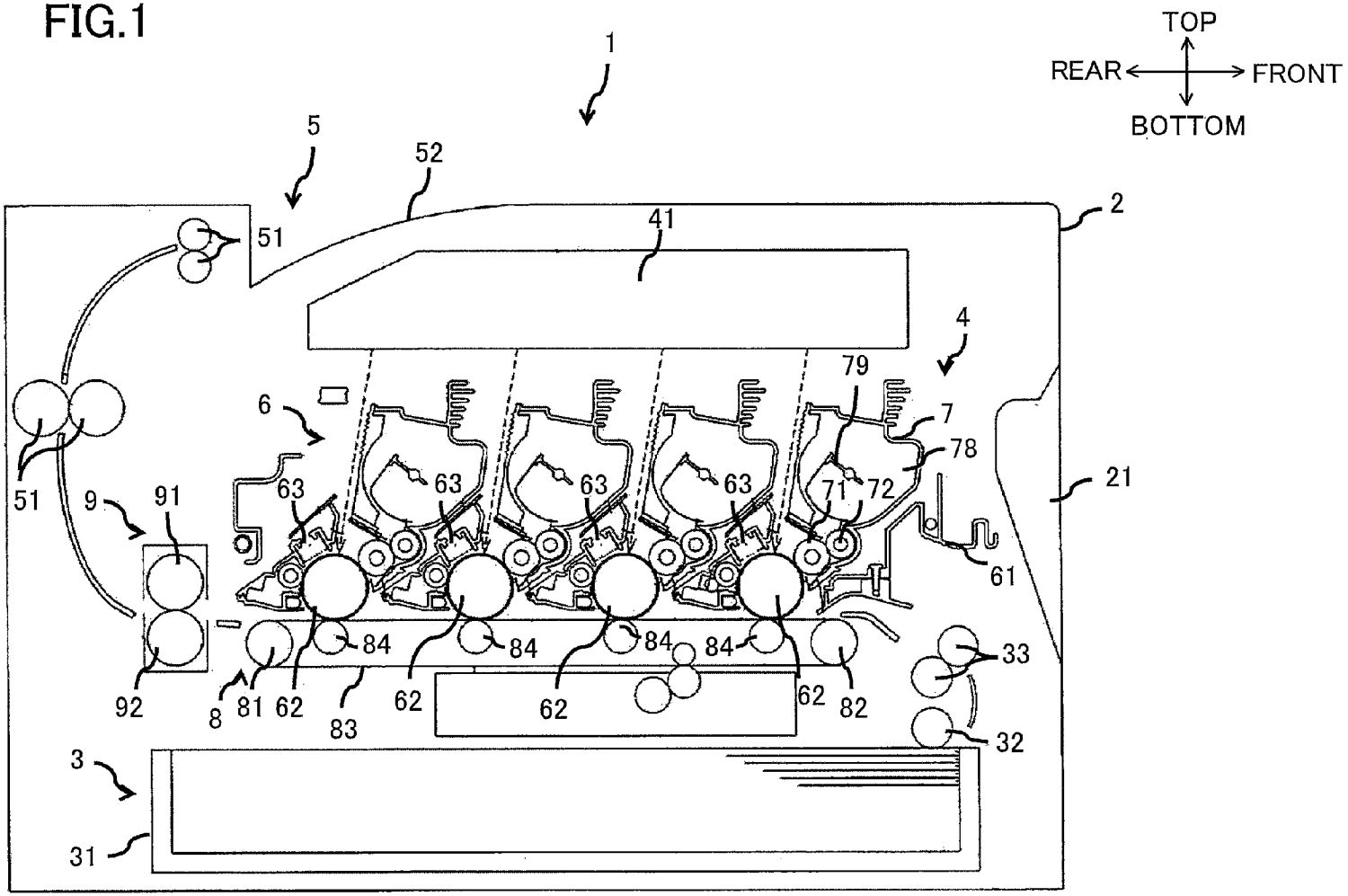
FIG. 1 is a side cross-sectional view illustrating a general configuration of a color laser printer incorporating a developing cartridge according to an embodiment of the present invention, the developing cartridge including a developing roller.

As shown in FIG. 1, the color laser printer 1 includes a main frame 2 within which a sheet supplying unit 3, an image forming unit 4, and a sheet discharging unit 5 are provided.

A movable front cover 21 is pivotally movably supported to a lower front end portion of the main frame 2 so as to cover and expose an opening formed on a front side of the main frame 2.

The sheet supplying unit 3 is disposed at a lower portion of the main frame 2. The sheet supplying unit 3 includes a sheet tray 31 for accommodating sheets therein, a sheet supply roller 32, and a pair of registration rollers 33. Each sheet accommodated in the sheet tray 31 is separated one by one and conveyed toward the image forming unit 4.

The image forming unit 4 includes an exposing section 41, a processing section 6, a transferring section 8 and a fixing section 9.

The exposing section 41 is disposed at an upper portion of the main frame 2. The exposure unit 4 includes a laser emitting portion, a polygon mirror, lenses and reflection mirrors (all now shown in FIG. 1). In this exposing section 41, a laser beam emitted from the laser emitting portion based on image data is scanned in a left-to-right direction by the polygon mirror at a high speed, passes through or reflected by the lens and the reflection mirrors, and is irradiated onto each photosensitive drum 62 (described later).

The processing section 6 is disposed below the exposing section 41 and above the sheet supplying unit 3. The processing section 6 includes a unit main body 61, and four developing cartridges 7 each storing toner of one of four colors used in the color laser printer 1: black, yellow, magenta and cyan.

The unit main body 61 includes four drum sub-units juxtaposed in a front-to-rear direction. Each drum sub-unit corresponds to each of the four developing cartridges 7 and includes the photosensitive drum 62 and a Scorotron charger 63.

The developing cartridges 7 for the colors of black, yellow, magenta and cyan are juxtaposed in this order, from upstream to downstream in a sheet conveying direction. Each developing cartridge 7 stores toner of a different color but has a configuration identical to one another.

Each developing cartridge 7 includes a developing casing 70 (see FIG. 2), a developing roller 71, a supply roller 72 and a toner accommodating chamber 78. The developing roller 71 is rotatably supported to the developing casing 70. The supply roller 72 supplies toner to the developing roller 71. The toner accommodating chamber 78 stores toner therein.

The developing roller 71 is configured of a roller shaft made of a metal, and a covering portion made of an electrically-conductive rubber material to cover the roller shaft. More specifically, the covering portion has a circumferential surface made of an electrically-conductive urethane runner or a silicon rubber including carbon particles, and the circumferential surface is covered with a coating layer made of urethane rubber or a silicon rubber including fluorine. The covering portion is brought into contact with the photosensitive drum 62.

The supply roller 72 is configured of a roller shaft made of a metal, and a covering portion covering the roller shaft and made of an electrically-conductive foamed material.

The toner accommodating chamber 78 stores therein non-magnetic monocomponent polymeric toner. Polymeric toner has a substantially spherical shape and has a high liquidity. Within the toner accommodating chamber 78, an agitator 79 is also provided for agitating the toner accommodated in the toner accommodating chamber 78.

In the processing section 6, the Scorotron charger 63 uniformly charges a surface of the photosensitive drum 62. The high-speed scanning of the laser beam emitted from the exposing section 41 then exposes the charged surface of the photosensitive drum 62 so that an electrostatic latent image is formed thereon. In the meantime, the toner stored in the toner accommodating chamber 78 is supplied to the developing roller 71 via the supply roller 72 and is tribocharged between the supply roller 72 and the developing roller 71. The toner is then supplied to the electrostatic latent image formed on the surface of the photosensitive drum 62 to form a toner image thereon.

The transferring section 8 is disposed above the sheet supplying unit 3 and below the processing section 6. The transferring section 8 includes a drive roller 81, a follower roller 82, an endless conveyor belt 83 and four transfer rollers 84.

The drive roller 81 and the follower roller 82 are disposed horizontally in opposition to each other. The conveyor belt 83 is mounted on the drive roller 81 and the follower roller 82 in a taut state. The conveyor belt 83 has an outer circumferential surface with which each of the photosensitive drums 62 is in contact. The conveyor belt 83 has an internal space within which the four transfer rollers 84 are disposed in correspondence with the photosensitive drums 62. The conveyor belt 83 is nipped between each pair of the transfer roller 84 and the photosensitive drum 62.

In the transferring section 8, at the time of image formation, when each sheet conveyed on the conveyor belt 83 passes between the photosensitive drum 62 and the transfer roller 84, the sheet is applied with a transfer bias from each transfer roller 84 to transfer the toner image carried on the surface of the photosensitive drum 62 onto the sheet.

The fixing section 9 is disposed rearward of the developing cartridges 7. The fixing section 9 includes a heat roller 91 and a pressure roller 92. The heat roller 91 is heated due to heat generated from a heat source (not shown) and the heat roller 91 is in pressure contact with the heat roller 91.

In the fixing section 9, when the toner image transferred on the sheet is thermally fixed thereon while the sheet passes between the heat roller 91 and the pressure roller 92.

The sheet discharging unit 5 includes discharge rollers 51, and a discharge tray 52. The image-formed sheet conveyed from the fixing section 9 is conveyed by the discharge rollers 51 and is finally discharged onto the discharge tray 52.

Next, a detailed configuration of the developing cartridge 7 according to the embodiment will be described with reference to FIGS. 2 through 7. Hereinafter, descriptions will be given assuming that the developing cartridge 7 is mounted in the main frame 2.

Figure 2:
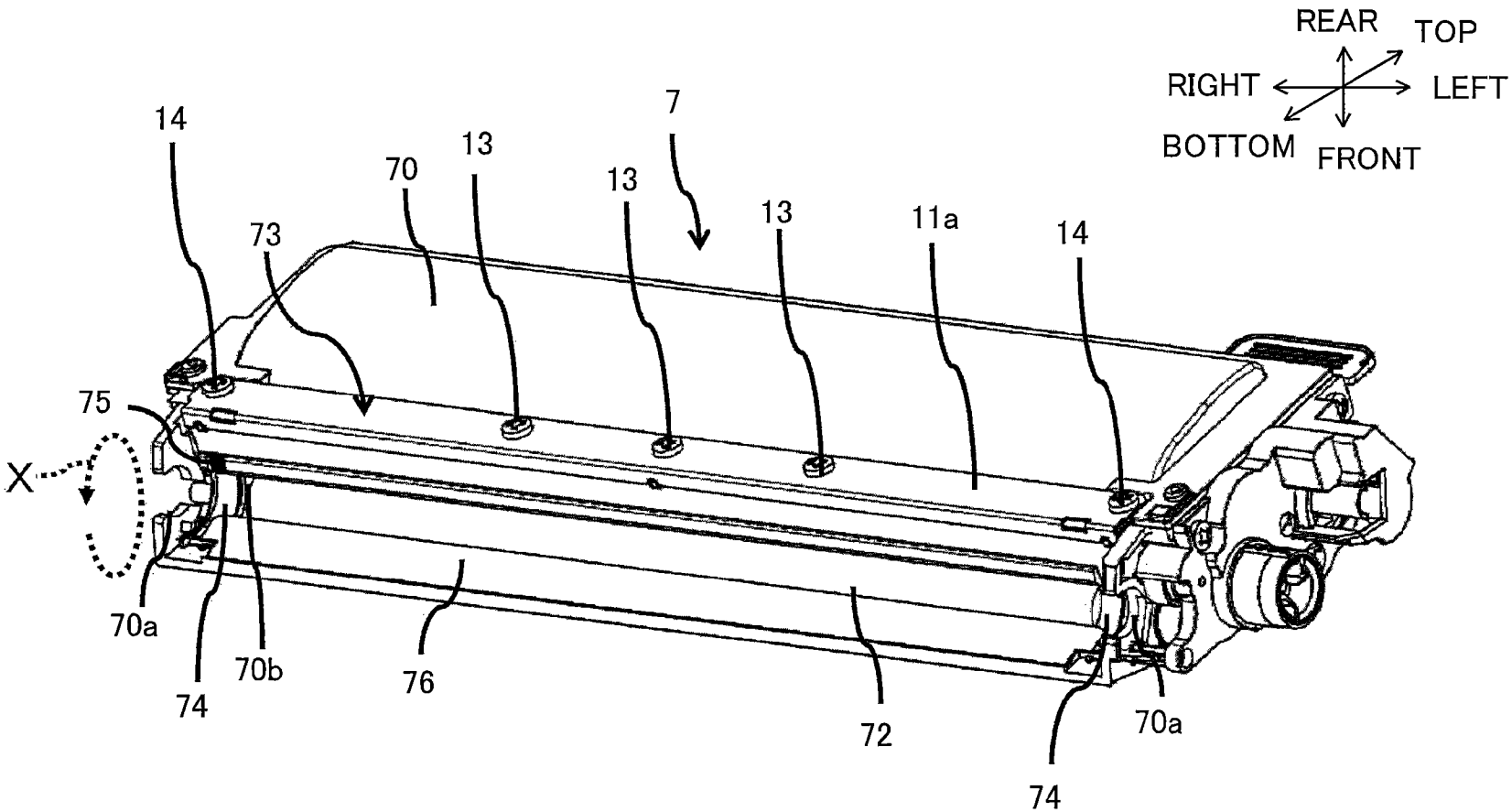
FIG. 2 is a perspective view of the developing cartridge according to the embodiment as viewed from a side rearward and diagonally downward of the developing cartridge, wherein the developing cartridge includes a blade unit and two blade sealing members but one of the blade sealing members and the developing roller is not shown.

As shown in FIG. 2, the developing cartridge 7 includes the developing casing 70, the developing roller 71 (omitted in FIG. 2), the supply roller 72, a blade unit 73, two side sealing members 74, a lower film 76 and two blade sealing members 75 (only one is show in FIG. 2).

The developing casing 70 includes two bearing portions 70*a* for rotatably supporting the roller shaft of the developing roller 71, an opening 70*b*, two side seal attachment portions and a lower film attachment portion.

The opening 70*b* has a substantially rectangular shape elongated in the left-to-right direction (i.e., an axial direction of the roller shaft of the developing roller 71). The opening 70*b* is provided for supplying toner within the toner accommodating chamber 78 to the developing roller 71 via the supply roller 72.

Each side seal attachment portion is respectively provided outward of each widthwise end portions of the opening 70*b* in the left-to-right direction. The side sealing members 74 are attached to the side seal attachment portions. The lower film 76 is attached to the lower film attachment portion.

Each side sealing member 74 is resiliently deformable and is disposed to be in sliding contact with each widthwise end portion of the covering portion of the developing roller 71. The lower film 76 slidingly contacts a lower portion of the covering portion of the developing roller 71. The developing roller 71 is configured to rotate in a rotational direction X shown in FIG. 2 such that the covering portion of the developing roller 71 can slidingly contact with the lower film 76, the side sealing members 74 and the blade sealing member 75 sequentially in this order.

Figure 3:
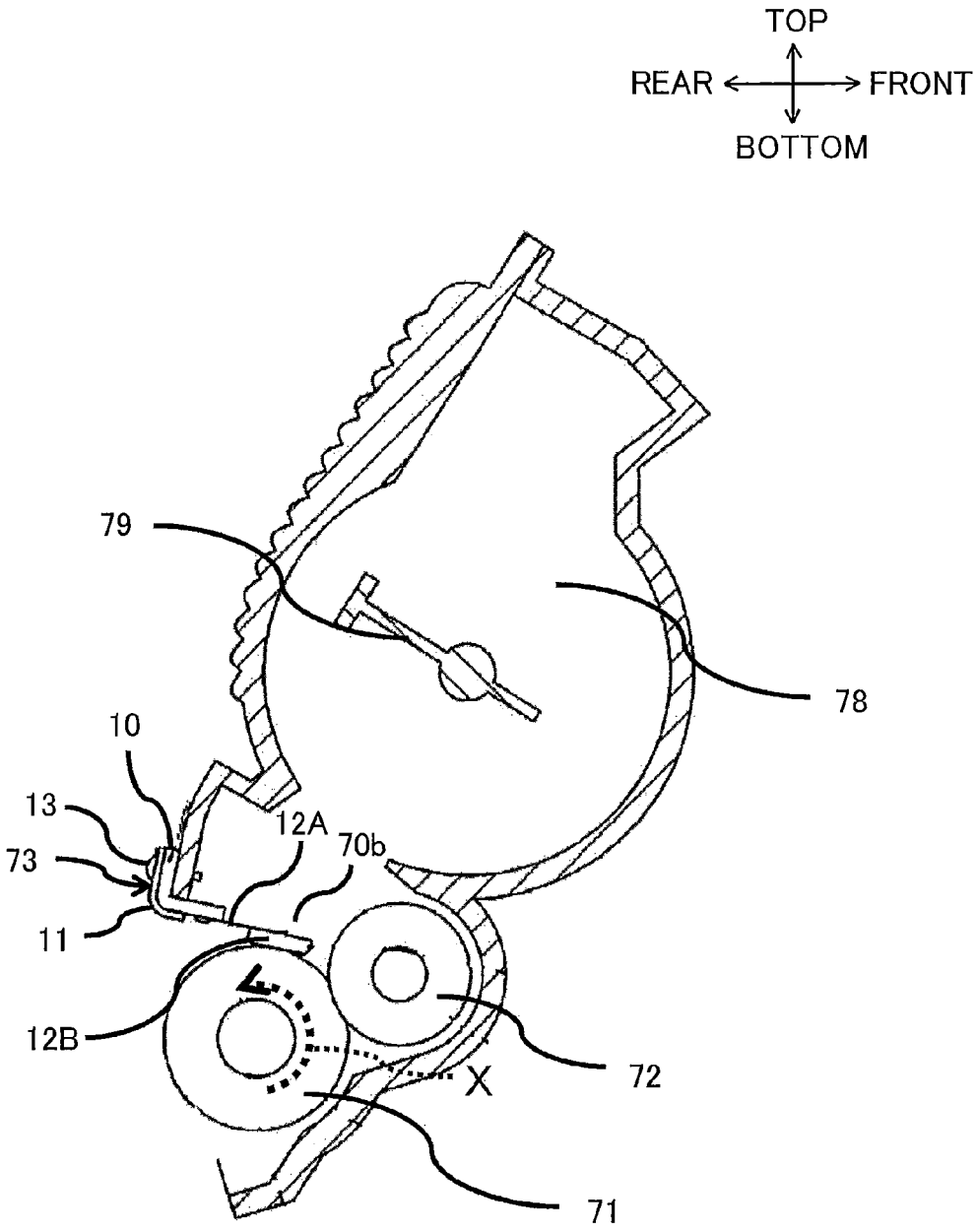
FIG. 3 is a central cross-sectional view of the developing cartridge according to the embodiment.

The blade unit 73 is fixed to the developing casing 70 at a position upward of and rearward of the opening 70*b*, as shown in FIGS. 2 and 3.

Figure 4:
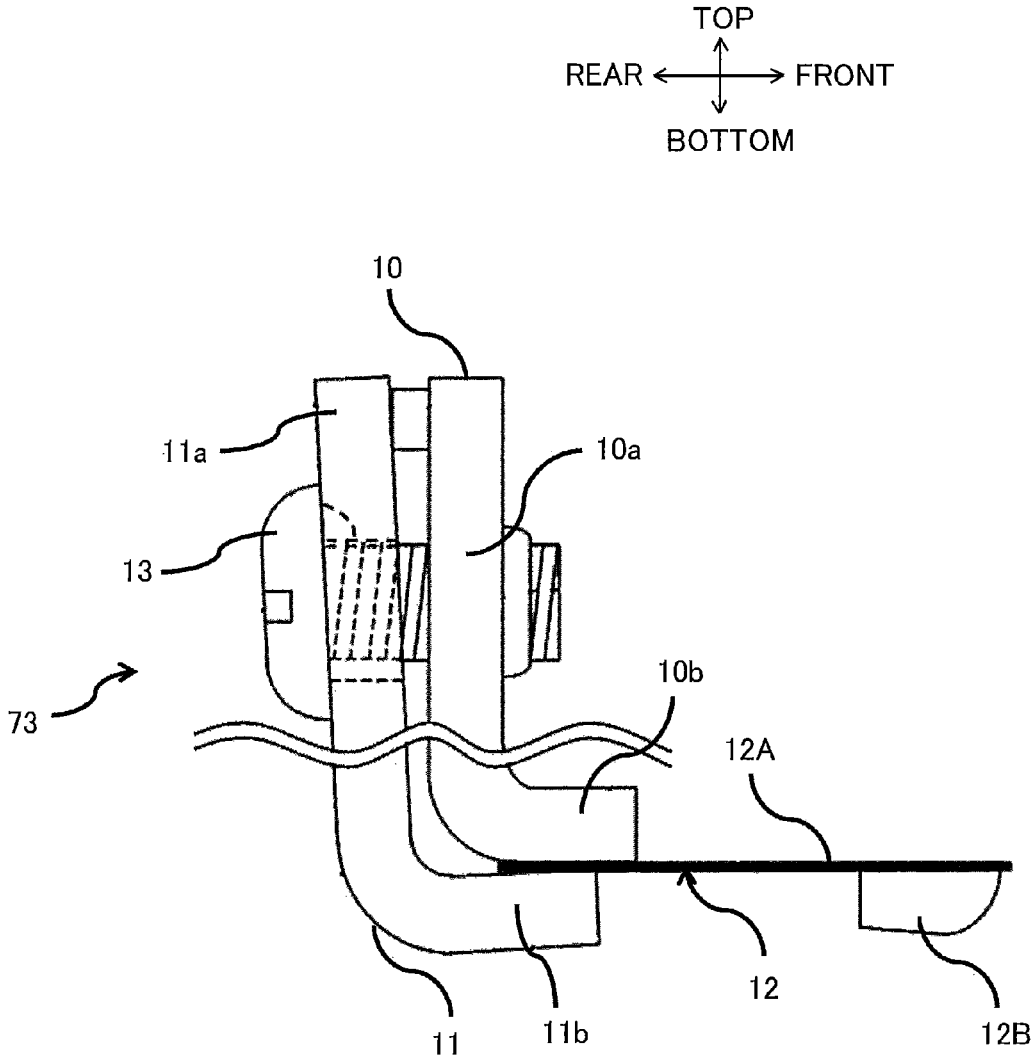
FIG. 4 is a schematic view showing a detailed configuration of the blade unit of FIGS. 2 and 3, wherein the blade unit includes a leaf spring and a pressing portion formed on the leaf spring.

The blade unit 73 extends in the left-to-right direction as shown in FIG. 2, and includes a thickness-regulation blade 12, a blade holder 10, and a blade reinforcing plate 11, as shown in FIG. 4.

The thickness-regulation blade 12 is a member for regulating a thickness of toner carried on the circumferential surface of the covering portion of the developing roller 71. Detailed configuration will be later described.

The blade holder 10 and the blade reinforcing plate 11 are fabricated respectively by bending a metal plate-like member at a substantially right angle. The blade holder 10 and the blade reinforcing plate 11 extend in the left-to-right direction to nip the thickness-regulation blade 12 therebetween.

More specifically, referring to FIGS. 2 and 4, the blade holder 10 is configured of a holding portion 10*a* and a nipping portion 10*b* extending substantially frontward from the holding portion 10*a*. Likewise, the blade reinforcing plate 11 is configured of a holding portion 11*a* and a nipping portion 11*b* extending substantially frontward from the holding portion 11*a*. Each of the holding portions 10*a*, 11*a* has a substantially rectangular plate-like shape elongated in the left-to-right direction whose short side is oriented in a substantially vertical direction. Each of the nipping portions 10*b*, 11*b* has a substantially rectangular plate-like shape elongated in the left-to-right direction whose short side is oriented substantially frontward.

Each of the holding portions 10*a*, 11*a* has widthwise end portions in the left-to-right direction on each of which a fixing hole (not shown) is formed. A fixing screw 14 is screwed into each fixing hole to fix the blade unit 73 to the developing casing 70, as shown in FIG. 2. Each of the holding portions 10*a*, 11*a* also has a central portion in the left-to-right direction on which a plurality of adjusting holes (not shown) are formed. An adjusting screw 13 is screwed into each adjusting hole such that a force to nip the thickness-regulation blade 12 between the nipping portions 10*b*, 11*b* can be adjusted in the blade unit 73.

The nipping portion 10*b* of the blade holder 10 has widthwise end portions in the left-to-right direction on each of which a boss is formed for positioning the thickness-regulation blade 12 on the blade holder 10.

The thickness-regulation blade 12 includes a leaf spring member 12A, a pressing portion 12B and two contact portions 12C, as shown in FIGS. 2 through 5.

The leaf spring member 12A has a substantially rectangular thin plate-like shape extending in the left-to-right direction. The leaf spring member 12A is made of a thin metal plate such as a stainless steel. The leaf spring member 12A has widthwise end portions in the left-to-right direction on each of which an engaging hole 18 is formed (see FIG. 5B). Each engaging hole 18 is engageable with the boss formed on each widthwise end portion of the nipping portion 10*b* of the blade holder 10.

Figure 5B:
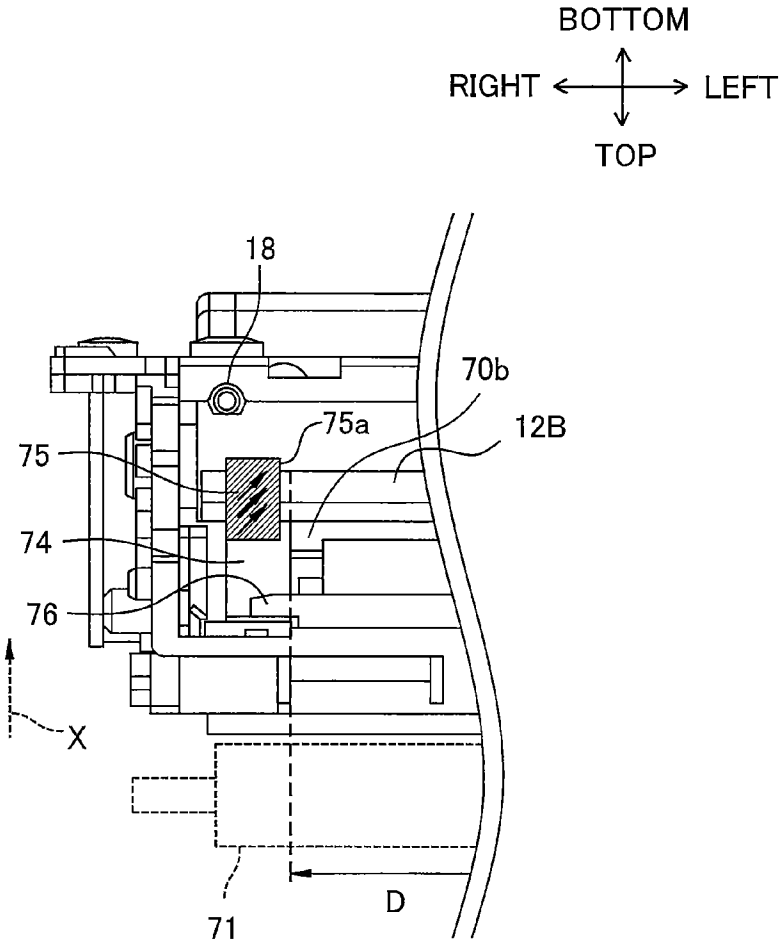
FIG. 5B is a partially-enlarged schematic view showing the right end portion of the developing cartridge of FIG. 2 as viewed from below, wherein the blade sealing member has been assembled to the leaf spring.
Figure 5A:
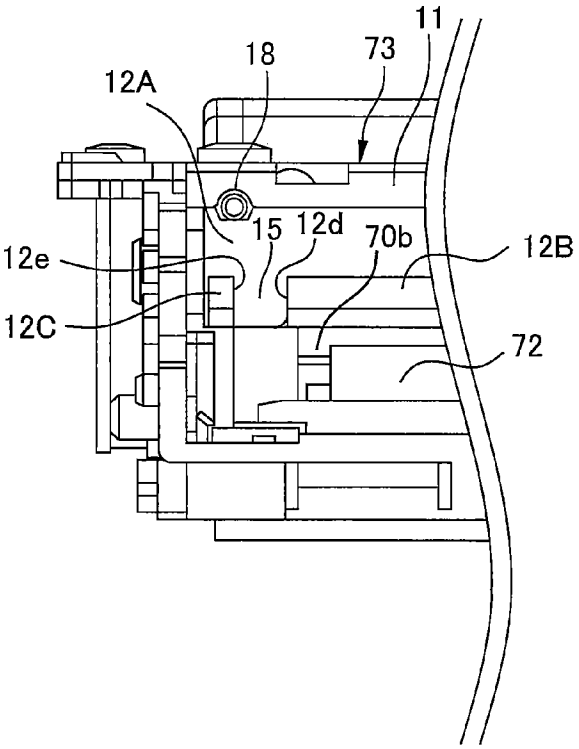
FIG. 5A is a partially enlarged schematic view showing a right end portion of the developing cartridge of FIG. 2 as viewed from below, wherein the blade sealing member is not yet assembled to the leaf spring.

The pressing portion 12B is formed of a silicon rubber. The pressing portion 12B is fixed to the leaf spring member 12A, more specifically, to a lower tip end portion of the leaf spring member 12A. As shown in FIG. 5B, the pressing portion 12B extends in the left-to-right direction to have a length longer than a region D of the covering portion of the developing roller 71 in the left-to-right direction, the region D corresponding to a maximum width of a sheet that can be used in the color laser printer 1.

As shown in FIG. 3, the pressing portion 12B is in pressure contact with the circumferential surface of the covering portion of the developing roller 71 due to a resilient force of the leaf spring member 12A. The pressing portion 12B is thus in contact with the developing roller 71 via a layer of toner formed thereon, thereby regulating thickness of the toner layer.

Figure 7:
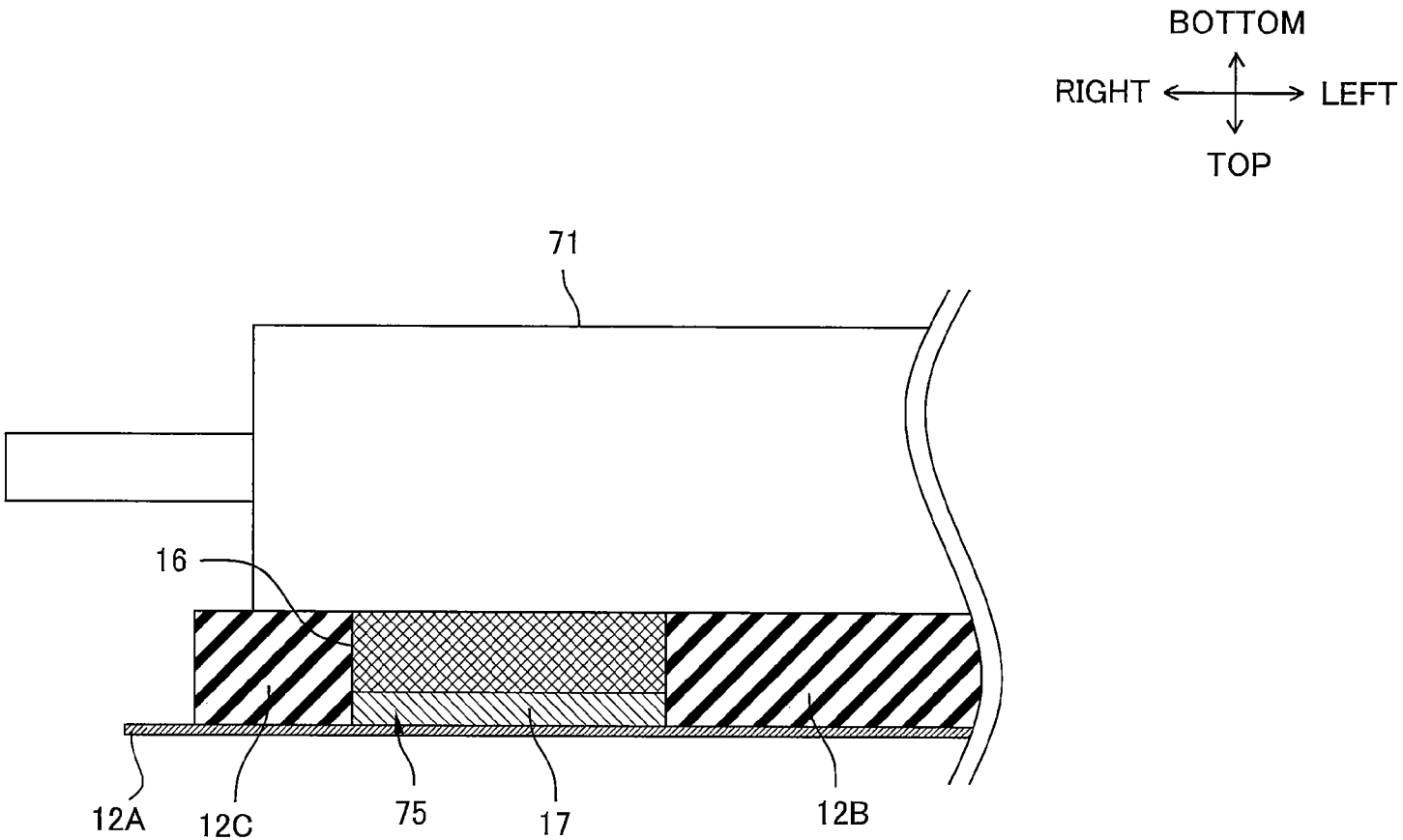
FIG. 7 is a partially-enlarged schematic view showing the right end portion of the leaf spring of FIG. 2 as viewed from its front side and illustrating a state where the blade sealing member has been assembled to the leaf spring and the developing roller has been assembled to the developing cartridge.

Each contact portion 12C is disposed outward of each widthwise end portion of the pressing portion 12B in the left-to-right direction. Just as the pressing portion 12B, the contact portion 12C is also formed of a silicon rubber. The contact portions 12C are fixed to the leaf spring member 12A such that the contact portions 12C are respectively in contact with the widthwise end portions of the covering portion of the developing roller 71 when the developing roller 71 is assembled to the developing casing 70, as shown in FIG. 7.

Figure 6:
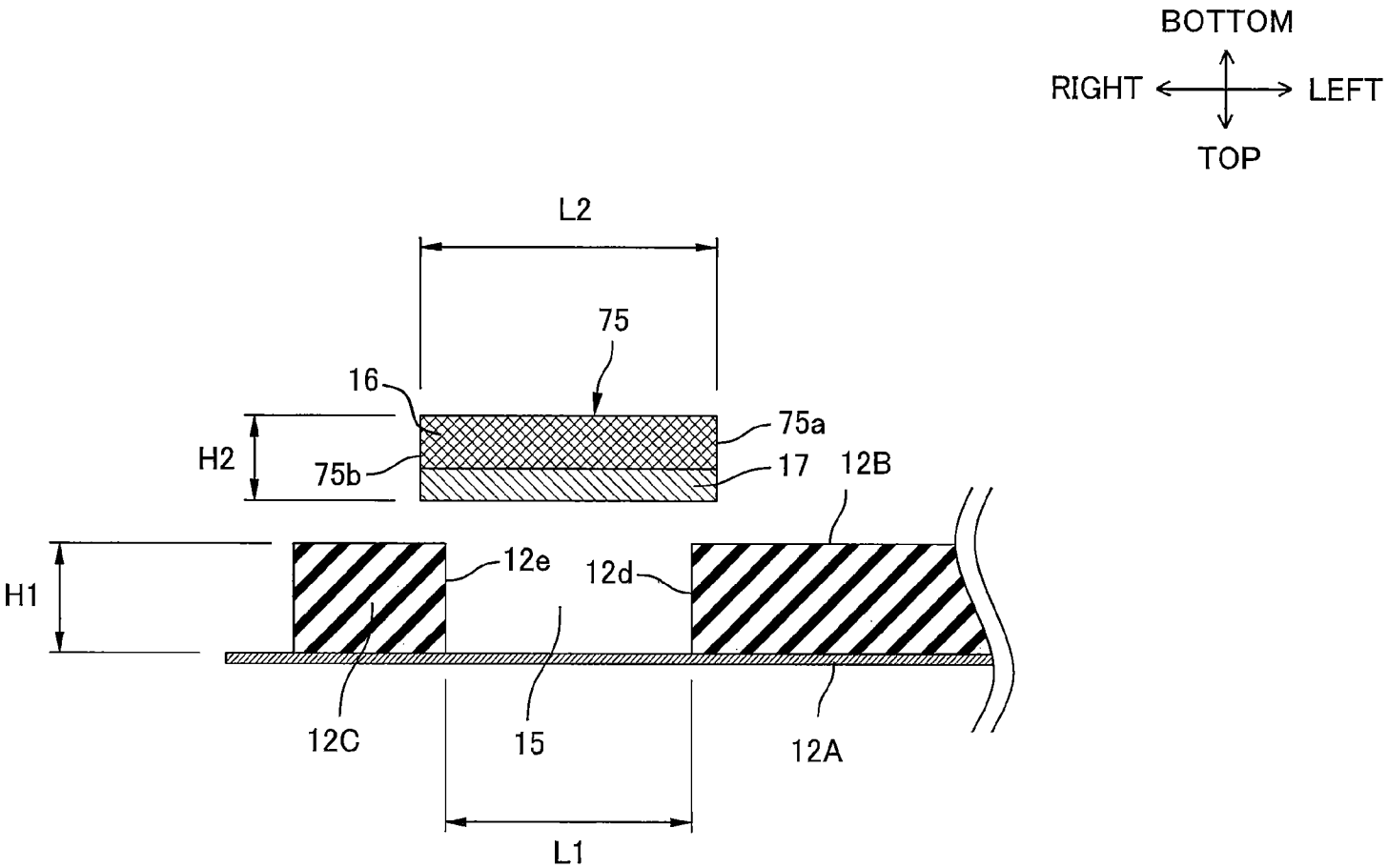
FIG. 6 is a partially-enlarged schematic view showing a right end portion of the leaf spring of FIG. 2 as viewed from its front side to illustrate how the blade sealing member is assembled to the leaf spring.

As shown in FIG. 6, each contact portion 12C is disposed in separation from the pressing portion 12B by a distance L in the left-to-right direction. Further, as will be described later, each contact portion 12C is disposed outward of the blade sealing member 75 in the left-to-right direction. In other words, as shown in FIGS. 5B and 6, each contact portion 12C is fixed on the leaf spring member 12A at a position outward of the side seal attachment portion which is positioned outward of widthwise end portion of the opening 70*b* in the left-to-right direction, thereby forming a groove 15 between each widthwise end portion of the pressing portion 12B and each contact portion 12C. Each groove 15 has a length L1 (or a distance L1) in the left-to-right direction.

More specifically, as shown in FIG. 6, the groove 15 is a space defined between an outer wall section 12*d* of the pressing portion 12B and an inner wall section 12*e* of the contact portion 12C in the left-to-right direction, the outer wall section 12*d* and the inner wall section 12*e* being substantially parallel to each other. In the present embodiment, the groove 15 has the length L1 of 4.85 mm in the left-to-right direction and a depth (height) H1 of 1.5 mm in the vertical direction. That is, the pressing portion 12B and the contact portion 12C have a height equal to each other (i.e., the depth H1).

The contact portion 12C of the above configuration has a hardness of eighty (80) degrees as a result of measurement by a durometer (CL-150, a product of KOBUNSHI KEIKI co. ltd.).

The pressing portion 12B and the contact portions 12C are manufactured by injection molding. Specifically, the leaf spring member 12A is inserted into a metal mold, and an elastic material for forming the pressing portion 12B and the contact portions 12C (silicon rubber in the embodiment) is subsequently injected into the mold. In this way, the pressing portion 1213 and the contact portions 12C are formed on the leaf spring member 12A.

The side sealing members 74 serve to prevent toner from leaking outside from the widthwise end portions of the opening 70*b* in the left-to-right direction, as shown in FIG. 2. Each side sealing member 74 is configured of a base member and a surface member (not shown). Specifically, the base member is formed of an elastically deformable material, such as urethane sponge, whose hardness is lower than that of the surface member. The surface member is formed of a material having a thickness smaller than that of the base member, such as felt. The surface member is attached to the base member by, for example, a double-sided adhesive tape. Each side sealing member 74 is attached to each side seal attachment portion by a double-sided adhesive tape or an adhesive agent.

The lower film 76 serves to prevent toner from leaking from between the outer circumferential surface of the developing roller 71 and the developing casing 70. The lower film 76 extends in the left-to-right direction and is in sliding contact with the outer circumferential surface of the developing roller 71. The lower film 76 is made of a sheet-like material having resiliently deformable characteristics, such as a PET (polyethylene terephthalate) sheet or a rubber sheet.

The lower film 76 is fixed to the lower film attachment portion of the developing casing 70 by a double-sided adhesive tape, for example. The lower film 76 extends in the left-to-right direction such that, when attached to the developing casing 70, the widthwise end portions of the lower film 76 extend beyond the lower film attachment portion and are placed on (over) the side sealing members 74 respectively, as shown in FIG. 5B.

The blade sealing members 75 are fitted into the grooves 15 between the pressing portion 12B and each contact portion 12C to prevent toner from leaking outside from therebetween.

As shown in FIGS. 5B and 6, the blade sealing member 75 has a substantially rectangular shape in a plan view. Each blade sealing member 75 is positioned outward of the region D of the developing roller 71 in the left-to-right direction. In other words, each blade sealing member 75 is disposed outward of each widthwise end portion of the opening 70*b* in the left-to-right direction. Each blade sealing member 75 has an upstream end in contact with each side sealing member 74 in the rotational direction X of the developing roller 71.

Each blade sealing member 75 has a length L2 greater than the length L1 of the groove 15 in the left-to-right direction, as shown in FIG. 6. More specifically, the blade sealing member 75 has the length L2 of 5.5 mm in the left-to-right direction and a depth (length) H2 of 1.3 mm in the vertical direction.

Each blade sealing member 75 is configured of a base member 16 and a fluffy-surfaced portion 17.

The base member 16 is made of an elastically deformable member, such as urethane sponge. The fluffy-surfaced portion 17 is raised (or napped) by weaving minute Teflon (registered trademark) fibers into a ground fabric woven by polyester warp and cotton woof. The fluffy-surfaced portion 17 is attached to the base member 16 by a double-sided adhesive tape. As shown in FIG. 5B, each fluff of the fluffy-surfaced portion 17 is laid down and diagonally inclined such that, in the rotational direction X, a downstream end of the fluff is positioned nearer to a laterally center of the opening 70*b* than an upstream end of the fluff to the laterally center of the opening 70*b*. In other words, in FIG. 5B, each fluff is laid down and inclined diagonally rearward and leftward.

The fluffy-surfaced portion 17 and the base member 16 have a length identical to each other in the left-to-right direction (i.e., the length L2), but have a height (or a length in the vertical direction) different from each other. More specifically, the base member 16 has a height of 0.4 mm, the fluffy-surfaced portion 17 has a height of 0.75 mm, and the double-sided adhesive tape interposed between the fluffy-surfaced portion 17 and the base member 16 has a height of 0.15 mm in the vertical direction.

The blade sealing member 75 of the above-configuration has a hardness of seventy-five (75) degrees as a result of measurement by the durometer (CL-150, a product of KOBUNSHI KEIKI co. ltd.). In other words, the blade sealing member 75 has a hardness lower than that of the contact portion 12C.

When the blade sealing member 75 is fitted with the groove 15, an outer peripheral portion 75*b* of the blade sealing member 75 is brought into intimate-contact with the inner wall section 12*e* of the contact portion 12C, while an inner peripheral portion 75*a* of the blade sealing member 75 is brought into intimate-contact with the outer wall section 12*d* of the pressing portion 12B. Thus, each blade sealing member 75 serves to prevent toner leakage from between each outer wall section 12*d* of the pressing portion 12B and the inner peripheral portion 75*a* of each blade sealing member 75.

As shown in FIG. 7, when the developing roller 71 is assembled to the developing casing 70, the blade sealing members 75, the pressing portion 12B and the contact portions 12C all elastically deform to have a height identical to one another.

As described above, the contact portion 12C is made of a material whose hardness is higher than that of the blade sealing member 75, and is fixed on the leaf spring member 12A at a position outward of the outer peripheral portion 75*b* of the blade sealing member 75 in the left-to-right direction. Each contact portion 12C is in contact with the outer circumferential surface of the developing roller 71 when the developing roller 71 is assembled to the developing casing 70, as shown in FIG. 7. Hence, a contact pressure at which each outer wall section 12*d* of the pressing portion 12B is in contact with the developing roller 71 can be made smaller than a case where the contact portions 12C are not provided. As a result, the outer wall sections 12*d* of the pressing portion 12B can be prevented from being abraded due to use of the developing cartridge 7 over time.

Further, the contact portions 12C are formed of the same elastic material as the pressing portion 12B. Specifically, the contact portions 12C and the pressing portion 12B are formed on the thickness-regulation blade 12 by: inserting the thickness-regulation blade 12 into the metal mold; and then by injecting the elastic material into the mold. Therefore, the contact portions 12C and the pressing portion 12B can be easily and simultaneously formed on the thickness-regulation blade 12 during a single manufacturing process.

Further, the contact portions 12C are designed to have the same height as the pressing portion 12B in the vertical direction. Hence, when the developing roller 71 is assembled to the developing casing 70 and brought into contact with the pressing portion 12B, the pressing portion 12B can be tightly pressed against the outer circumferential surface of the developing roller 71 without being separated therefrom. As a result, the toner leakage from between the pressing portion 12B and the outer circumferential surface of the developing roller 71 can be prevented even after long time use of the developing cartridge 7.

While the invention has been described in detail with reference to the embodiments thereof, it would be apparent to those skilled in the art that various changes and modifications may be made therein without departing from the spirit of the invention.

What is claimed is:

1. A developing device comprising:

a casing having an opening extending in a first direction;

a developing roller positioned adjacent to the opening and configured to rotate about an axis extending in the first direction, the developing roller having an outer circumferential surface on which developer is carried;

a thickness-regulation portion comprising a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion of the thin-plate member, the regulating portion being in contact with the outer circumferential surface of the developing roller via the developer for regulating thickness of the developer on the outer circumferential surface, the regulating portion having an end face extending in a direction crossing the first direction;

a sealing member disposed on the thin-plate member and in intimate contact with the end face of the regulating portion for suppressing leakage of the developer from the casing; and a contact portion fixed on the thin-plate member at a position closer to the lateral end than the sealing member to the lateral end, the contact portion being in contact with the outer circumferential surface of the developing roller and made of a material having a hardness higher than that of the sealing member.

2. The developing device according to claim 1, wherein the regulating portion is made of a material identical to the material of the contact portion.

3. The developing device according to claim 1, wherein the regulating portion and the contact portion have a height identical to each other in a third direction perpendicular to the first direction.

4. The developing device according to claim 1, wherein the regulating portion and the contact portion define a gap therebetween in the first direction, the sealing member being assembled to the gap.

5. The developing device according to claim 1, wherein the thin-plate member has a first lateral end and a second lateral end spaced away from each other in the first direction; and wherein the regulating portion has a first end face and a second end face spaced away from each other in the first direction; and wherein the sealing member comprises a first sealing member and a second sealing member spaced away from each other in the first direction and interposing therebetween the regulating portion; and wherein the contact portion comprises a first contact portion positioned closer to the first lateral end than the first sealing member to the first lateral end, and a second contact portion positioned closer to the second lateral end than the second sealing member to the second lateral end.

6. A process unit comprising:

a photosensitive member having a circumferential surface on which an electrostatic latent image is formed; and a developing device for supplying developer to the electrostatic latent image, the developing device comprising:

a casing having an opening extending in a first direction;

a developing roller positioned adjacent to the opening and configured to rotate about an axis extending in the first direction, the developing roller having an outer circumferential surface on which developer is carried;

a thickness-regulation portion comprising a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion of the thin-plate member, the regulating portion being in contact with the outer circumferential surface of the developing roller via the developer for regulating thickness of the developer on the outer circumferential surface, the regulating portion having an end face extending in a direction crossing the first direction;

a sealing member disposed on the thin-plate member and in intimate contact with the end face of the regulating portion for suppressing leakage of the developer from the casing; and a contact portion fixed on the thin-plate member at a position closer to the lateral end than the sealing member to the lateral end, the contact portion being in contact with the outer circumferential surface of the developing roller and made of a material having a hardness higher than that of the sealing member.

7. An image forming device comprising:

a process unit comprising:

a photosensitive member having a circumferential surface on which an electrostatic latent image is formed; and a developing device for supplying developer to the electrostatic latent image to form a developer image, the developing device comprising:

a casing having an opening extending in a first direction;

a developing roller positioned adjacent to the opening and configured to rotate about an axis extending in the first direction, the developing roller having an outer circumferential surface on which developer is carried;

a thickness-regulation portion comprising a thin-plate member extending in the first direction along the opening and having a base end portion fixed to the casing and extending in the first direction and a free end portion, the thin-plate member having a lateral end extending in a second direction crossing the first direction; and a regulating portion extending in the first direction and fixed to the free end portion of the thin-plate member, the regulating portion being in contact with the outer circumferential surface of the developing roller via the developer for regulating thickness of the developer on the outer circumferential surface, the regulating portion having an end face extending in a direction crossing the first direction;

a sealing member disposed on the thin-plate member and in intimate contact with the end face of the regulating portion for suppressing leakage of the developer from the casing; and a contact portion fixed on the thin-plate member at a position closer to the lateral end than the sealing member to the lateral end, the contact portion being in contact with the outer circumferential surface of the developing roller and made of a material having a hardness higher than that of the sealing member;

an exposure unit that exposes a scanned light to the photosensitive member;

a transfer unit that transfers the developer image formed in the process unit to a sheet; and a fixing unit that fixes the developer image to the sheet.

* * * * *